United States Patent [19]

O'Reilly et al.

[11] 4,012,074

[45] Mar. 15, 1977

[54] DEVICE FOR ADJUSTING THE LEGS OF ADJUSTABLE WHEELCHAIRS

[76] Inventors: Bernard M. O'Reilly, 470 Earle St.; James F. Best, 105 W. Suffolk Ave., both of Central Islip, N.Y. 11722

[22] Filed: Dec. 2, 1975

[21] Appl. No.: 636,922

[52] U.S. Cl. ..... 297/434; 7/12; 7/17; 81/3 R; 254/131; 297/DIG. 4

[51] Int. Cl.[2] ..... A47C 7/50

[58] Field of Search ..... 297/429, 433, 434, DIG. 4; 254/120, 131; 29/278; 81/3 R; 7/1 G, 12, 17

[56] References Cited

UNITED STATES PATENTS

| | | | |
|---|---|---|---|
| 1,030,660 | 6/1912 | Hunt | 254/131 |
| 1,364,947 | 1/1921 | Molloy | 254/131 X |
| 3,000,632 | 9/1961 | Fuchs | 297/433 X |
| 3,376,067 | 4/1968 | Kernes | 297/433 X |

*Primary Examiner*—James C. Mitchell

[57] ABSTRACT

A device for elevating and lowering the legs of a wheelchair which is provided with adjustable legs. The device comprises a first generally elongated member having a free end and adapted to be gripped and operated by the invalid in the wheelchair, a second generally elongated member integral with said first elongated member and formed angularly therewith and a generally C-shaped clamping portion integral with and at the free end of said second elongated member. The clamping portion is formed of a pair of opposite side portions, one of said side portions having a lip portion extending in the same direction as said side portion.

2 Claims, 4 Drawing Figures

Fig.1.
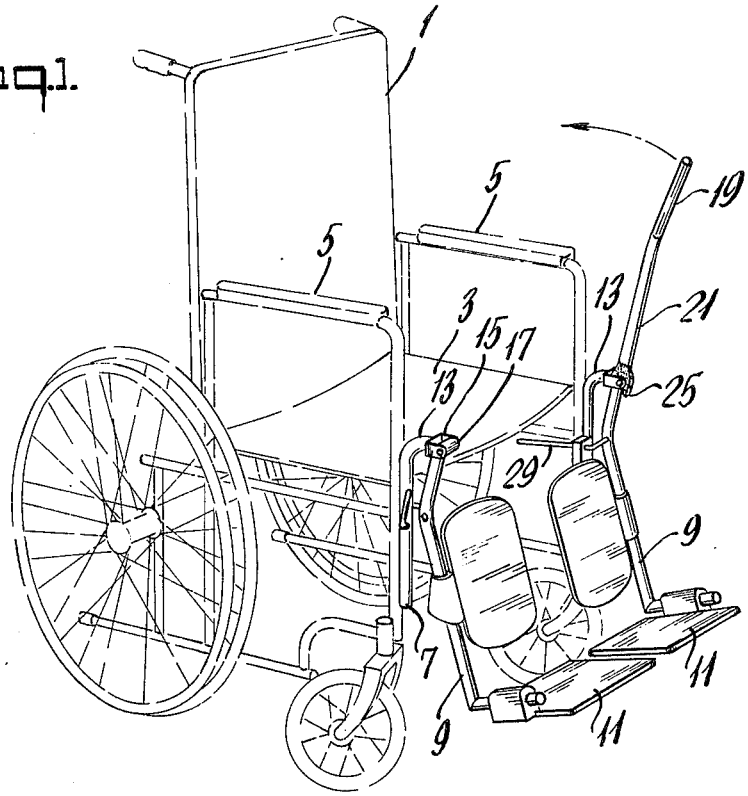
Fig.2.
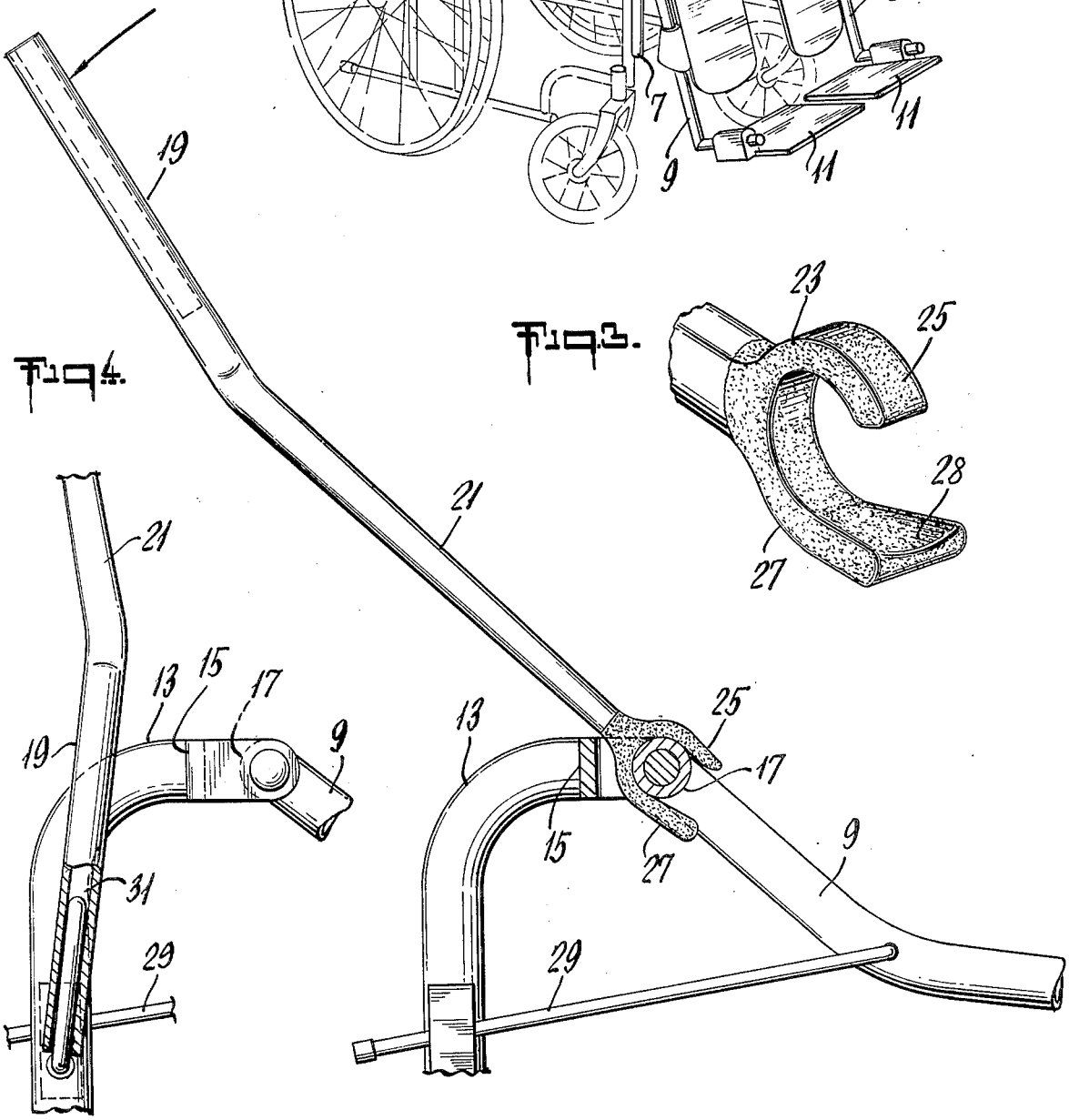
Fig.3.
Fig.4.

DEVICE FOR ADJUSTING THE LEGS OF ADJUSTABLE WHEELCHAIRS

BACKGROUND OF THE INVENTION

1. Field of Invention

This invention relates to wheelchairs which are equipped with adjustable legs and is particularly related to a device for use in conjunction with such wheelchairs in order to elevate and lower the legs to any desired position.

2. The Prior Art

Wheelchairs of the type provided with adjustable legs have proven to be of great aid to invalids during their period of confinement. So far as it is known, however, commonly available wheelchairs are usually equipped with leg-adjusting mechanisms or assemblies which are integral parts of the wheelchair and which are difficult or inconvenient to operate. Moreover, the provision of such mechanisms or assemblies as integral parts of such wheelchairs complicates the manufacture and increases the cost of the wheelchairs.

SUMMARY OF THE INVENTION

In accordance with this invention, there is provided a device for elevating and lowering the legs of a wheelchair which is provided with adjustable legs. The device comprises a first generally elongated member having a free end and adapted to be gripped and operated by the invalid in the wheelchair, a second generally elongated member integral with said first elongated member and formed angularly therewith, and a generally C-shaped clamping portion integral with and at the free end of said second elongated member. The clamping portion is formed of a pair of opposite side portions, one of said side portions having a lip portion extending in the same direction as said side portion.

The manner of use of the device of this invention for elevating and lowering the legs of the wheelchair will become apparent from the following detailed description of the invention and the accompanying drawings.

DESCRIPTION OF THE DRAWINGS

FIG. 1 is a perspective view of a wheelchair of the type equipped with adjustable legs showing the device of this invention mounted adjacent the left leg thereof;

FIG. 2 is a side elevational view of the device of this invention, with parts broken away, and showing the leg of the wheelchair in elevated position;

FIG. 3 is a perspective view of the C clamping portion of the device of this invention, and FIG. 4 is a side elevational view of the device of this invention, with parts broken away, illustrating the manner of engagement of the device into the release rod of the wheelchair.

Like numerals in the drawings designate like parts.

DETAILED DESCRIPTION OF THE INVENTION

In accordance with this invention it has now been found that the adjustable legs of a wheelchair can be raised and lowered to any desired position by a device which is uniquely constructed for this purpose and which is not an integral part of the wheelchair. Rather, the device of this invention is portable, can be releasably engaged to the sides next to the left or right arm of the wheelchair and can be readily maneuvered by the invalid to raise and lower the legs to any desired convenient height without interfering with their comfort. The device of this invention is usually of unitary construction and may be made of metal or plastic and may be used on different wheelchairs. Thus, it differs from most prior art devices which are usually an integral part of the wheelchair and hence cannot be used for other wheelchairs.

Referring now to FIG. 1, there is shown a typical wheelchair which comprises the frame 1 and seat 3, arm rests 5, a pair of angular substantially vertical front members 7 secured to the frame 1 and extending downwardly below the seat 3. The wheelchair also includes a pair of front legs 9 having the usual foot rests 11. The legs 9 extend downwardly of the wheelchair to a point slightly above the floor at their lowest position so that each leg can be raised or lowered freely.

A pair of angular, substantially inverted L-shaped support members 13 are removably attached to the front members 7 of the wheelchair for engagement with the device of this invention. The inverted L-shaped members 13 include a substantially horizontal, forward projecting portions 15 each having a recess or cavity 17 near the forward end thereof adapted to receive the device of this invention as will hereinafter be explained. The legs 9 are pivoted to the members 13 by a pin 12 at the cavity 17 which acts as a fulcrum for the device.

As illustrated in FIG. 2, the device of this invention comprises a first elongated portion 19 adapted to be gripped and operated by the invalid in the wheelchair, and a second elongated portion 21 integral with said first elongated portion 19 and formed angularly therewith. At the free end of the second elongated portion 21 there is provided a generally C-shaped clamping portion 23 formed of opposite side portions 25 and 27. The side portion 27 has a lip portion 28 which extends in the same direction as the side portion 27 and is adapted to be inserted into the cavity 17 and exerts leverage on the leg of the wheelchair to raise the leg to any desired position. The inside surface of the lip portion 28 may be coated with a suitable coating material (e.g., polytetrafluorethylene or an elastomeric material such as rubber) in order to protect the finish of the wheelchair.

In order to use the device of this invention to raise the left legs of the wheelchair for example, the invalid would simply grip the elongated portion 19 and insert the lip 27 into the recess or cavity 17 provided in L-shaped member 13 next to the left leg of the wheelchair. The elongated portion 19 is then pulled back and a slight upward force exerted on the leg by the lip portion 28 until the leg reaches the desired position. The leg may be maintained in a selected raised position by a suitable retaining mechanism which may comprise a horizontally aligned rod 29 which slides through a clutching mechanism having a control handle (not shown). The clutching mechanism grips the rod as it is inserted and releases it only upon actuation of the control handle.

In order to lower the leg, the force applied on the leg is removed, and the invalid simply reaches over to push the release rod 31 forward thereby causing the leg to drop to a lower position.

In one embodiment of this invention which is illustrated in FIG. 4, the elongated portion 19 includes an internal elongated cavity into which the release rod 31 may be inserted. Thus after raising the leg as aforesaid, the device is removed, the elongated portion 21 is fitted over the release rod 31 and a slight forward pressure is applied to disengage the leg and cause it to drop to a lower position.

It is evident from the foregoing description that several modifications may be made in the construction of the device of this invention. Such modifications and other obvious variations are, however, within the scope and contemplation of this invention.

What is claimed is:

1. A wheelchair including a frame, a seat mounted on said frame, a plurality of wheels, means to rotably mount said wheels on said frame, a pair of support members connected to said frame, two adjustable legs each pivotally attached to one of said support members, each of said legs comprising a bar member pivoted near its top to said support member and a foot support member attached near the opposite end of said bar member, said bar member having a rounded top portion, in combination therewith, a device for elevating and lowering said legs of said wheelchair, said device comprising a generally elongated member comprising as integral portions thereof, a first elongated portion having a free end and adapted to be gripped and operated by the invalid using the wheelchair, a second generally elongated portion having a free end integral with said first elongated portion and formed angularly with said first elongated portion, a generally C-shaped clamping portion integral with and at the free end of said second elongated portion, said clamping portion being formed of opposite first and second side portions, a lip portion integral with and extending from one of said side portions in the same direction as said side portion, said clamping portion being adapted to exert leverage on said leg to raise said leg by fitting on its top rounded portion.

2. A wheelchair as in claim 1 wherein said first elongated portion has an elongated internal cavity at its free end, said wheelchair having a leg elevation release mechanism and a control handle for said release mechanism, said cavity being adapted to fit over said control handle for the leg elevation release mechanism of said wheelchair.

* * * * *